US009926053B1

(12) United States Patent
Ascencio

(10) Patent No.: US 9,926,053 B1
(45) Date of Patent: Mar. 27, 2018

(54) POWERED BOAT LIFT MECHANISM

(71) Applicant: Jason Michael Ascencio, White Lake, MI (US)

(72) Inventor: Jason Michael Ascencio, White Lake, MI (US)

( * ) Notice: Subject to any disclaimer, the term of this patent is extended or adjusted under 35 U.S.C. 154(b) by 0 days.

(21) Appl. No.: 15/404,088

(22) Filed: Jan. 11, 2017

Related U.S. Application Data

(60) Provisional application No. 62/276,991, filed on Jan. 11, 2016.

(51) Int. Cl.
*B63C 3/06* (2006.01)
*B63C 3/14* (2006.01)

(52) U.S. Cl.
CPC . *B63C 3/06* (2013.01); *B63C 3/14* (2013.01)

(58) Field of Classification Search
CPC ..... B63C 3/06
See application file for complete search history.

(56) References Cited

U.S. PATENT DOCUMENTS 4,954,011 A * 9/1990 Stenson ..... B63B 23/48 114/48
5,143,182 A * 9/1992 Basta ..... B66B 9/00 114/44
5,287,821 A * 2/1994 Godbersen ..... B63C 3/06 114/44
5,664,513 A * 9/1997 Echelbarger ..... B63C 1/02 114/263
5,970,813 A * 10/1999 Parkins ..... F16H 1/16 114/366
7,850,147 B1 * 12/2010 Fox ..... B66D 1/14 254/296
8,690,127 B2 * 4/2014 Patterman, Jr. ..... B63C 1/00 254/10 B

OTHER PUBLICATIONS http://shoremaster.com/lifts/motors/LIFT MATE.

* cited by examiner

*Primary Examiner* — Frederick L Lagman

(57) ABSTRACT

An electric powered auxiliary drive operates the elevator of a boat lift via the lift's hand wheel.

11 Claims, 4 Drawing Sheets

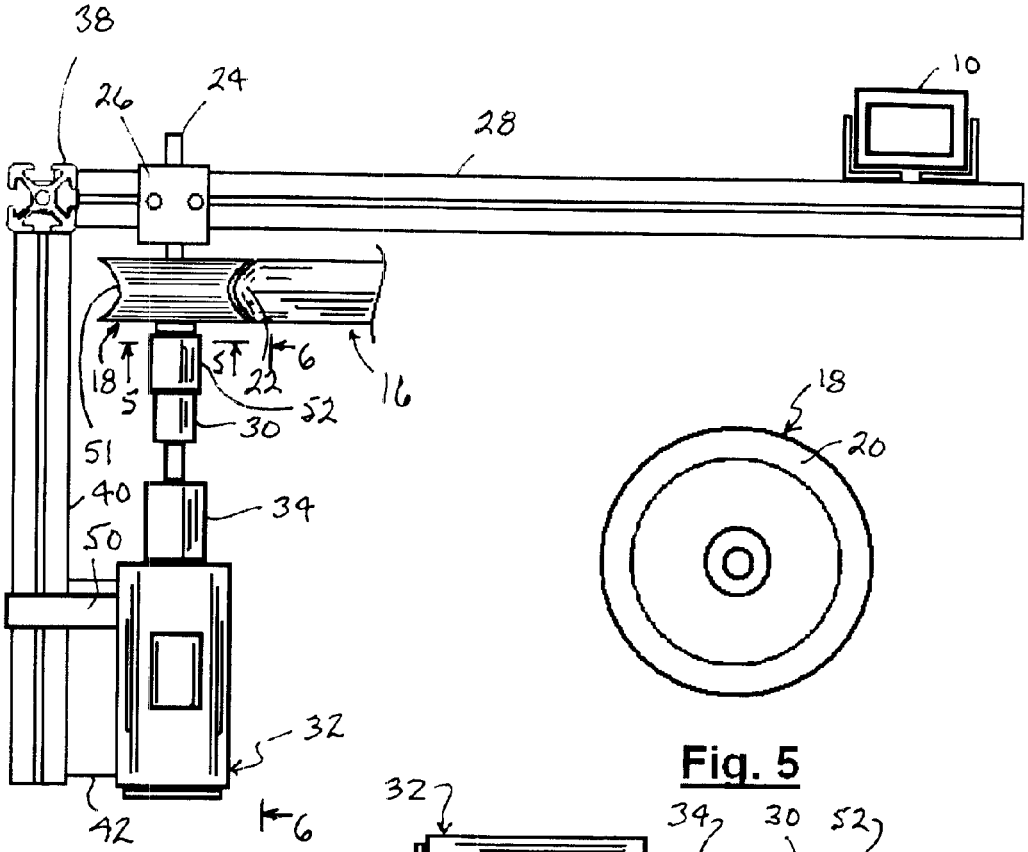
Fig. 4
Fig. 5
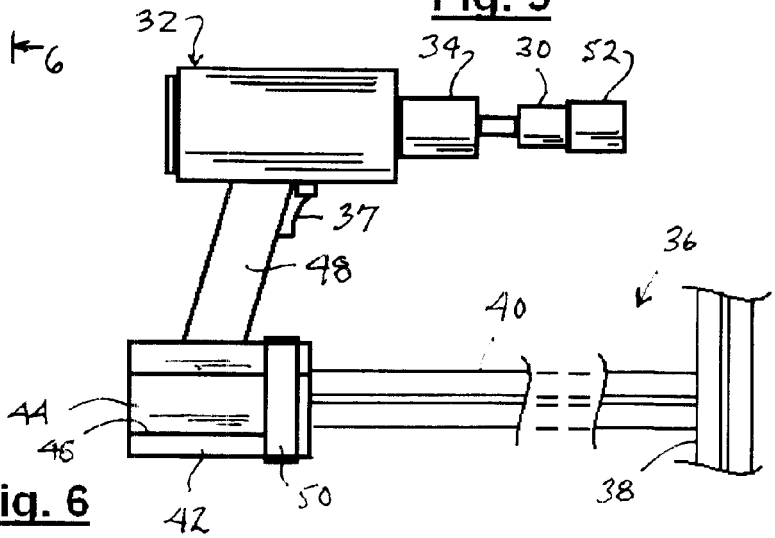
Fig. 6

POWERED BOAT LIFT MECHANISM

DOMESTIC PRIORITY CLAIM

This application claims priority of Provisional Patent Application No. 62/276,991 filed Jan. 11, 2016.

FIELD OF THE INVENTION

This invention relates to a boat lift, especially to an electric powered mechanism for a boat lift.

BACKGROUND OF THE INVENTION

A typical boat lift for smaller recreational type boats comprises a frame which is installed in water which is adjacent a shore of a body of water such as a lake. The boat lift has a frame comprising upright posts which are arranged at locations around a perimeter of the frame and which typically have large feet enabling the frame to sit on the bed of the body of water. The uprights are spaced apart so that a boat can enter and exit space bounded by the frame perimeter. The frame supports an elevator for vertical or cantilever raising and lowering of a boat within that space. The elevator comprises a lift platform providing underlying support for a hull of a boat, and a mechanism for raising and lowering the lift platform.

One example of such a mechanism comprises a gear box mounted on the frame. The gear box has an input shaft and an output shaft. The output shaft is coupled to the lift platform by a system which includes pulleys and cables. The gearbox provides a mechanical advantage which multiplies torque being applied to the input shaft so that greater torque is developed at the output shaft when torque is being applied to the input shaft in a direction for vertical or cantilever raising of the lift platform. The gearbox reduces torque being applied by the weight of the boat on the lift platform as the boat is being lowered although the mere weight of the boat on the lift platform is insufficient to cause the output shaft to rotate due to a brake-like clutch.

Raising and lowering of the lift platform may be performed manually and/or electrically. A large diameter hand wheel coupled to the input shaft can be manually turned in one direction to raise the lift platform and in the other direction to lower the lift platform.

A bidirectional electric motor, either AC or DC can be used to raise and lower the lift platform.

SUMMARY OF THE INVENTION

The invention relates to general and specific structure, and principles of operation, of disclosed embodiments of electric powered boat lifts which are hereinafter described with reference to the following drawings.

BRIEF DESCRIPTION OF THE DRAWINGS

FIG. 4 is a top plan view of a portion of the disclosed electric powered boat lift.

FIG. 5 is an enlarged view in the direction of arrows 5-5 in FIG. 4.

FIG. 6 is a view in the direction of arrows 6-6 in FIG. 4.

DETAILED DESCRIPTION

Figure 1:
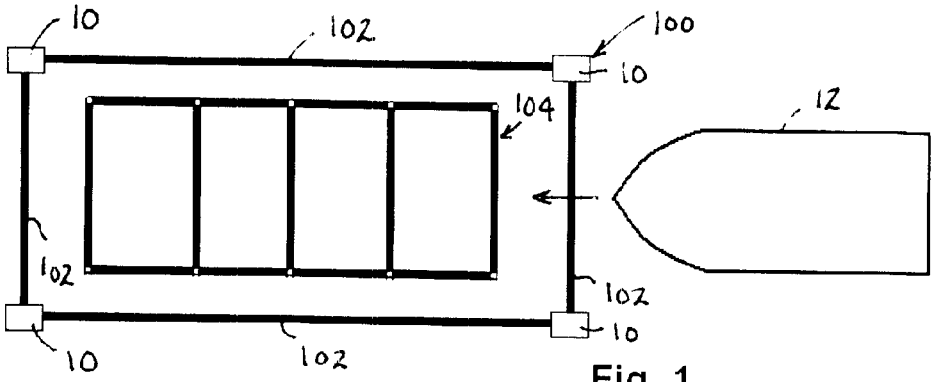
FIG. 1 is a schematic top plan view of a boat lift.
Figure 2:
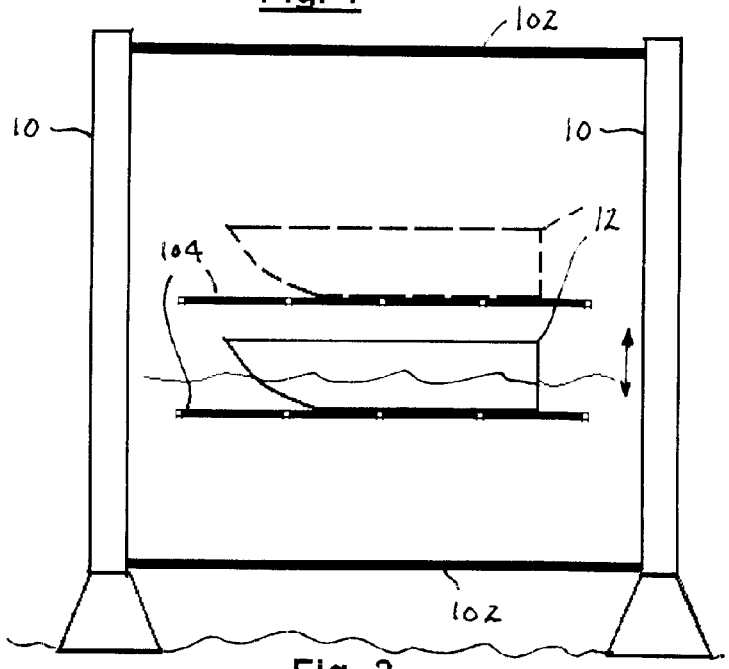
FIG. 2 is a front elevation view of the boat lift.

FIGS. 1 and 2 show a main boat lift frame 100 having upright vertical posts 10 standing on a bed of a body of water and horizontal bars 102 which join posts 100 to form a generally rectangular structure. Posts 10 are spaced apart so that a boat 12 can enter and exit space bounded by the frame perimeter, as suggested by FIG. 1. Frame 100 supports an elevator 104, one example of which is a lift platform shown in FIGS. 1 and 2, for vertically raising and lowering a boat 12, as suggested by FIG. 2, within a space bounded by the perimeter of the frame.

Figure 3:
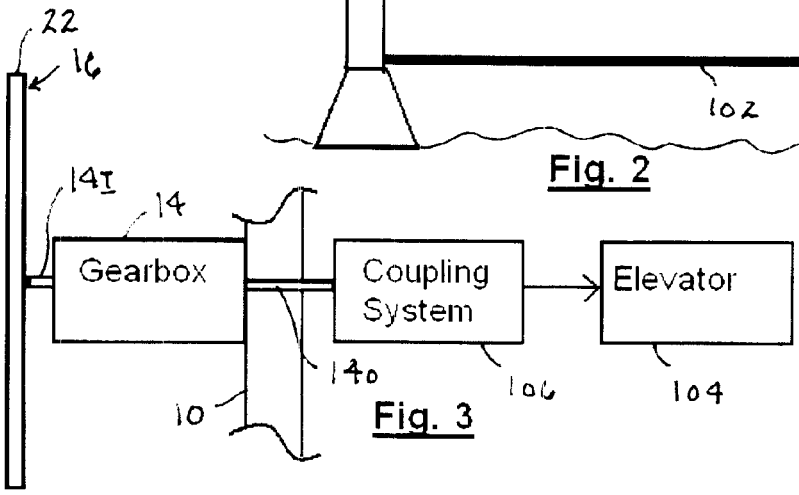
FIG. 3 is schematic diagram of a portion of the boat lift.

A main operating system for raising and lowering elevator 104 comprises a mechanism which includes a gearbox 14 mounted on a post 10 as shown in FIG. 4. FIG. 3 shows gear box 14 to have an input shaft 14I and an output shaft 14O, with output shaft 14O being coupled with elevator 104 by a coupling system 106 which for example comprises a system of pulleys and cables. Gearbox 14 provides a mechanical advantage which multiplies torque being applied to input shaft 14I so that greater torque is developed at output shaft 14O when torque is being applied to input shaft 14I in a direction for raising elevator 104 with a boat 12 on it. The gearbox reduces torque being applied by the weight of the boat on the elevator as the boat is being lowered although that weight is insufficient to cause the output shaft to rotate due to a brake-like clutch.

A large diameter hand wheel 16 coupled to input shaft 14I can be manually turned in one direction to raise elevator 104 and in the other direction to lower the elevator.

The invention provides an electric-powered auxiliary mechanism for operating elevator 104 via hand wheel 16. The auxiliary mechanism comprises a small drive wheel 18 of smaller diameter than that of hand wheel 16. Small drive wheel 18 has a circular perimeter rim 20, a portion of which bears against a perimeter rim 22 of hand wheel 16 with sufficient frictional contact to enable turning of small drive wheel 18 to turn hand wheel 16.

Small drive wheel 18 is supported by an axle shaft 24 which extends horizontally to the rear where it is itself supported by a block 26 which is fastened to a horizontal bar 28 which may be a bar of main frame 100, or as shown in the Figs. here, a bar which is fastened to a post 10 of main frame 100.

There are several possibilities for mounting small drive wheel 18 for rotation about its own axis. 1) Small drive wheel 18 may be fastened to axle shaft 24 so that the two turn together in which case, block 26 would be a pillow block which provides journal or bearing support of axle shaft 24 for rotation about the axle shaft's own axis. 2) Small drive wheel may be free to turn on axle shaft 24 in which case axle shaft 24 need not necessarily turn on block 26.

The electric power source of the auxiliary mechanism shown in FIGS. 5 and 6 is a portable, pistol-grip type, battery-operated electric drill 32. Drill 32 comprises an internal driveshaft which has an external tool chuck 34 at one end. The axis of the tool chuck is in horizontal alignment with the common axis of drive wheel 18 and axle shaft 24.

A drive tool 30 has a shank which is inserted into and gripped by tool chuck 34, and the end of tool chuck 34 opposite its shank is coupled with axle shaft 24 when small drive wheel 18 is fastened to axle shaft 24 so that the two turn in unison and axle shaft 24 protrudes through small drive wheel 18. FIGS. 4 and 6 show a reversible ratchet clutch 52, to be explained later, through which tool chuck 34 is coupled with axle shaft 24. If drive wheel 18 is supported for rotation on the axle shaft and is not rotatively coupled to the axle shaft, the chuck may be a polygonally shaped socket which fits to a polygonally shaped boss on the drive wheel. The sense in which chuck 34 rotates can be selected by a switch on drill 32. Rather than being battery operated, the drill can alternately be one which is connected by an electric cord to a shore power receptacle, thereby providing a more permanent installation because disassembly to remove a battery for re-charging is unnecessary.

A drill support structure 36 is fastened to bar 28 to support drill 32 at a location which enables chuck 34 to be placed as described above. The drill support structure also acts to eliminate counter-torque of the drill when the drill is operated by a finger-operable trigger 37.

Drill support structure 36 comprises a vertical bar 38 which is fastened to and depends from bar 28 and a horizontal bar 40 fastened to and extending forwardly from vertical bar 38. A ledge, or platform, 42 is fastened to bar 40 at one side. A re-chargeable battery 44 separably attaches to a receptacle in the drill's handgrip 48 and forms the base 46 of the pistol grip when the drill is battery operated.

Drill 32 is held fast in place on ledge 42 by a strap 50 which wraps around a portion of battery 44, a portion of base 46, bar 40 and ledge 42. Bars 38, 40 and ledge 42 are constructed to provide proper positioning of the drill to align chuck 34 with axle shaft 24. With the drill resting on ledge 42, bar 40 acts as a torque bar which keeps the body of the drill from counter rotating. The drill can be operated without strap 50 in place, but the strap is an extra measure of safety which holds the drill firmly in place when operating to prevent the drill from jumping off ledge 42.

Rim 20 is made of a material which has a large coefficient of friction and has a generally semicircular concave groove 51 which fits to the outer circumference of hand wheel rim 22.

The coupling of chuck 34 to shaft 24 may include a reversible ratchet clutch 52 which can be set to either clockwise or counter-clockwise rotation. The reversible ratchet clutch is applied as a safety measure to prevent drills with an automatic brake from locking up at high rotational speed when lowering the lift platform.

Figure 7:
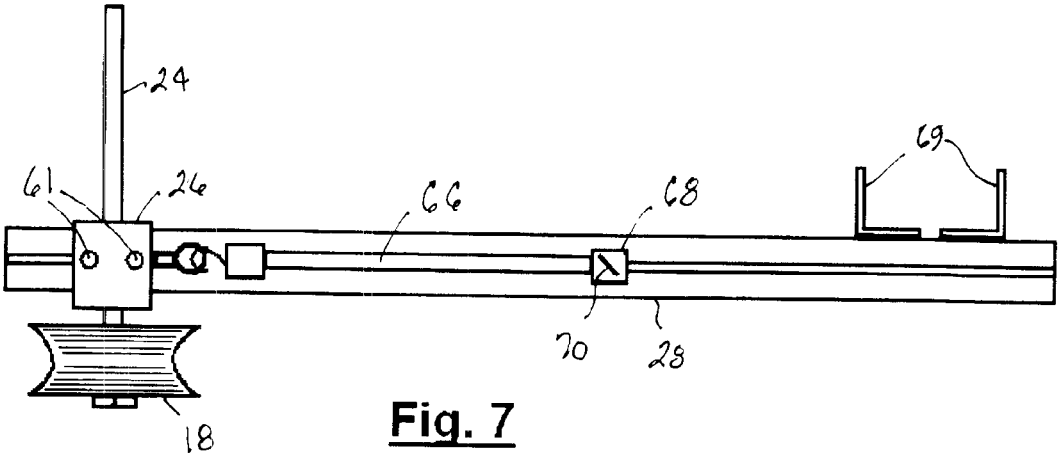
FIG. 7 is a top plan view of a modified embodiment.
Figure 8:
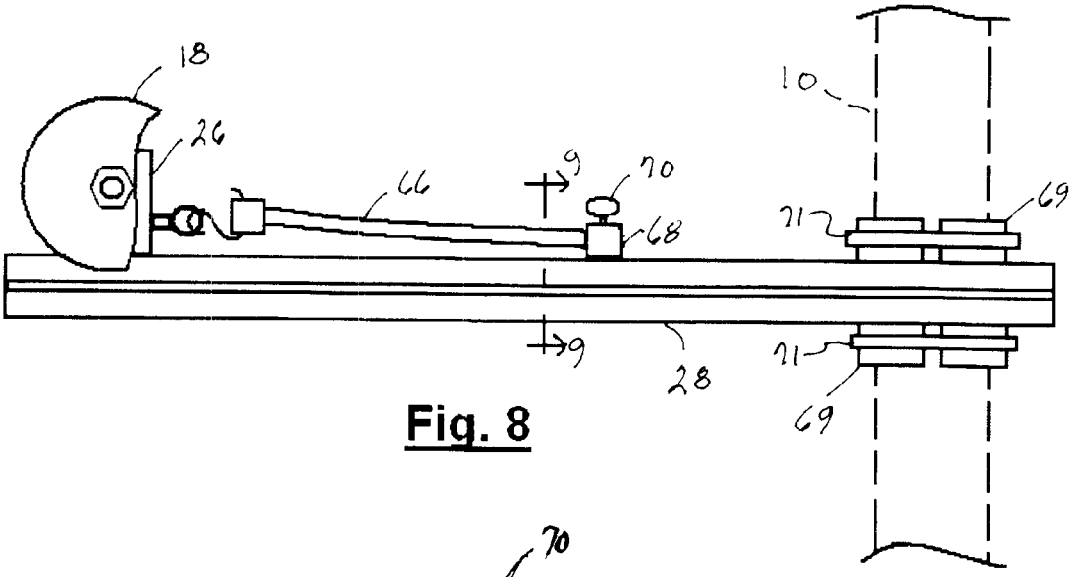
FIG. 8 is a front elevation view of FIG. 7.
Figure 9:
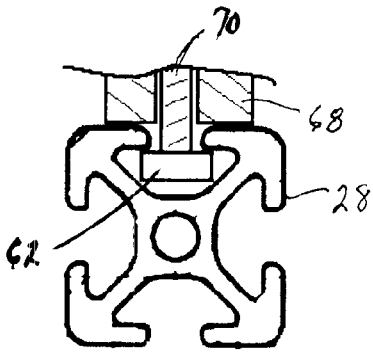
FIG. 9 is an enlarged transverse cross section view in the direction of arrows 9-9 in FIG. 8.

The bars which have been mentioned above are, by way of example, four-sided extruded aluminum bars which provide lengthwise extending channels 60 as shown in FIGS. 7-9. FIG. 7 shows that one of the channels is used to mount block 26 in a manner which allows block 26 to slid along the channel to a desired position along the length of bar 28 where small drive wheel 18 comes into contact with hand wheel 16. Block 26 may be tightly fastened in place by tightening fasteners comprising screws 61 which engage nuts which are captured in the channel. (FIG. 9 shows how a nut 62 is captured in the channel.) However block 26 need not be tightly fastened when a tensioning force is applied to force small drive wheel 18 against hand wheel 16 as shown in FIGS. 7 and 8.

FIGS. 7 and 8 show an embodiment which enables a settable tractive force to be applied by small drive wheel 18 to hand wheel 16. Small drive wheel 18 is placed in contact with hand wheel 16. An elastic bunge cord 66 is connected between block 26 and a block 68 which is adjustably positionable along the length of bar 28 to set the extent to which bunge cord 66 is stretched by virtue of the distance of block 68 from block 26. Once desired tensioning has been set, a thumbscrew 70 is tightened to a nut captured in the track of bar 28 to hold block 68 secure on bar 28.

FIGS. 7 and 8 also show two right-angle brackets 69 fastened to bar 28 for closely fitting to post 10. Clamps 71 are wrapped around the brackets and post and tightened to hold bar 28 securely in place on the post.

Figure 10:
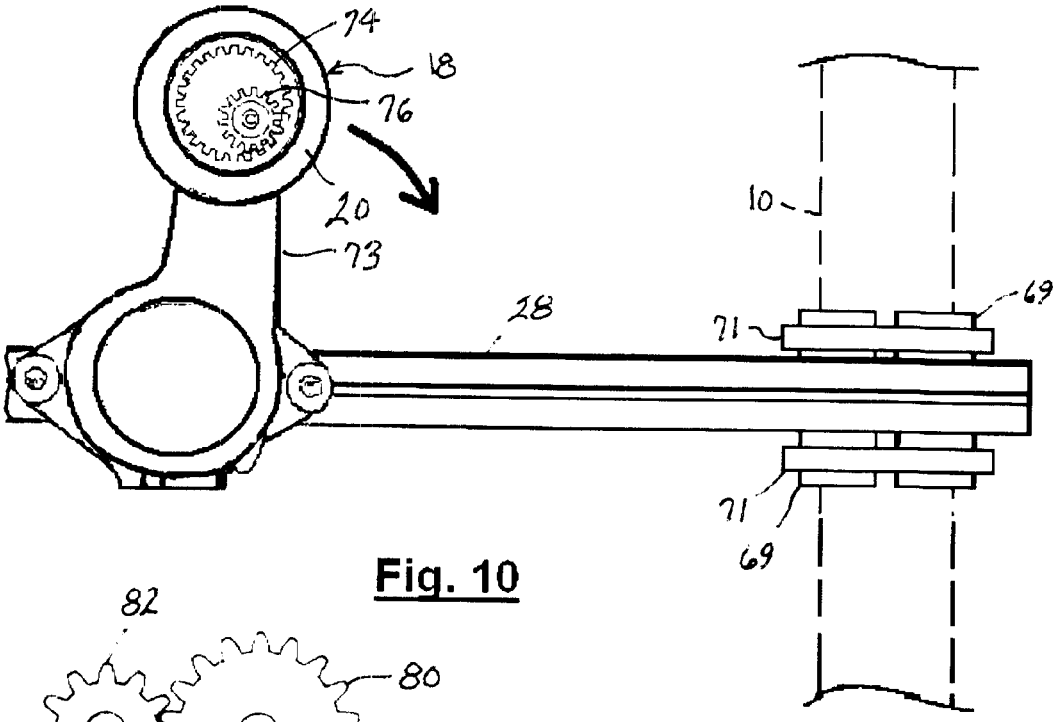
FIG. 10 is a view in the same direction as FIG. 8 showing a modified embodiment.

FIG. 10 shows another embodiment for applying a settable tractive force to small drive wheel 18. The base of a tensioner is mounted on bar 28 in the same manner as described above for block 26. An arm 73 can swing on the base about an axis, as suggested by the arrow. Arm 73 is spring-biased by a spring housed within the base toward hand wheel 16. Small drive wheel 18 is mounted on an end of spring-biased arm 73 and is thereby forced against the hand wheel by the spring. The force exerted against the hand wheel is set by the location at which the base is secured on bar 28.

A ring gear 74 is mounted on the interior of small drive wheel 18 and a pinion 76 is in mesh with the ring gear. The pinion is coupled with the electric drill 32 to turn small drive wheel 18. Because the diameter of pinion 76 is less than the diameter of ring gear 74, increased torque multiplication is applied to the small drive wheel in comparison to an arrangement in which the drill is in-line with the axis of the small diameter wheel and directly turns the small drive wheel. Use of the gear mechanism may allow the drill to be held in hand by a person without the drill being strapped to an auxiliary frame because the reaction torque is reduced. The torque amplification may enable the lift to operate with a less powerful electric drill.

A planetary gear set (not shown) may be used to couple the electric drill with ring gear 74, and would allow the drill chuck to be coaxial with drive wheel 18.

Figure 11:
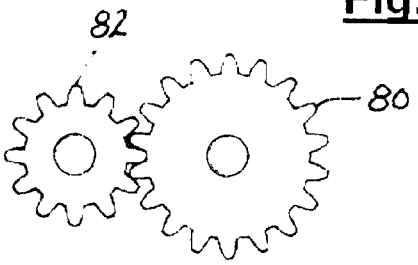
FIG. 11 is an enlarged view showing a modified form of FIG. 10.

FIG. 11 shows another gear arrangement in which a gear 80 is fastened concentrically to the small drive wheel and a pinion gear 82 of smaller diameter on the drill is used to turn the gear 80. This arrangement has the same advantages as described for FIG. 10.

Figure 12:
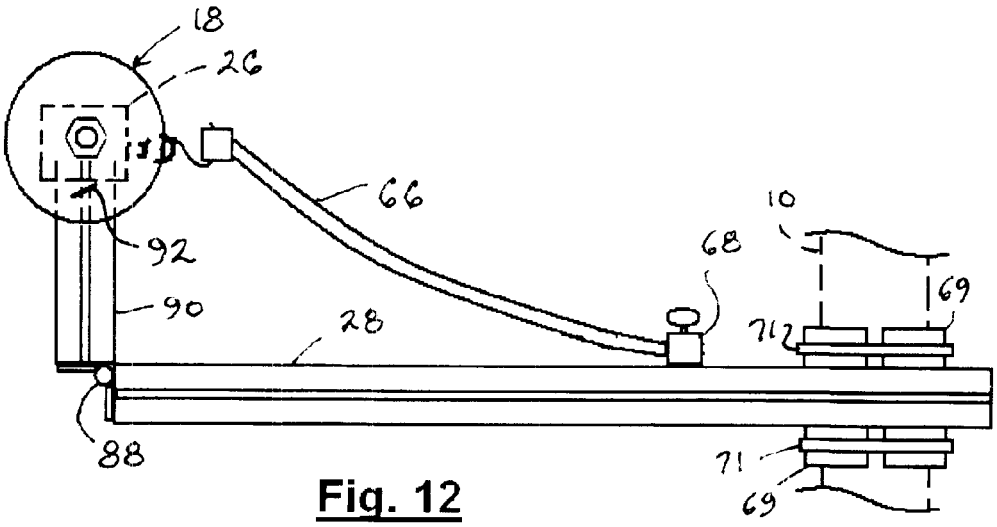
FIG. 12 is a view similar to FIG. 8 showing a modified embodiment.

In FIG. 12 a hinge 88 attaches an additional bar 90 to the left end of bar 28 to allow bar 90 to be swung at 90 degrees upwardly to bar 28 as shown. Block 26 is mounted on bar 90 in a similar manner to how it is mounted on bar 28 in FIGS. 7 and 8. A thumbscrew 92 is fastened to bar 90 to prevent block 26 and hence drive wheel 18 from falling down. Bunge cord 66 is tensioned between block 68 and block 26. This arrangement allows drive wheel 18 to be positioned for turning hand wheel 16 when the hand wheel has a different geometric arrangement to bar 28 than it had in FIGS. 7 and 8.

What is claimed is:

1. A boat lift comprising:

a frame;

an elevator operable on the frame to raise and lower a boat hull supported on the elevator;

a main operating mechanism for operating the elevator;

the main operating mechanism comprising a gear box which is mounted on the frame and has an output shaft, an input shaft, and a torque multiplication mechanism through which the input shaft is coupled with the output shaft;

a coupling system which couples the output shaft with the elevator;

a large diameter wheel which turns by turning the input shaft;

an auxiliary operating mechanism for operating the elevator comprising a bar on the frame, a small diameter wheel, an axle shaft supporting the small diameter wheel for rotation about an axis on a part which can slide along a length of the bar to a location which places a circumference of the small diameter wheel in tangential contact with a circumference of the large diameter wheel for applying tractive force to turn the large diameter wheel and operate the elevator when the small diameter wheel rotates about the axis; and an electric motor drive for rotating the small diameter wheel to cause the smaller diameter wheel to apply tractive force to turn the large diameter wheel, the electric motor drive having a pistol-grip handle containing a finger-operable trigger for controlling operation of the electric motor drive.

2. The boat lift as set forth in claim 1 in which the electric motor drive comprises a rotatable shaft containing a drive gear, the small diameter wheel comprises a driven gear in mesh with the drive gear, and the ratio between the drive gear and the driven gear causes the driven gear to rotate at a slower speed than the drive gear thereby amplifying torque of the drive gear to turn the driven gear.

3. The boat lift as set forth in claim 2 in which the drive gear comprises external teeth and the driven gear has internal teeth which mesh with the external teeth of the drive gear.

4. The boat lift as set forth in claim 1 including a tensioning mechanism for setting force which the small diameter wheel exerts on the large diameter wheel.

5. The boat lift as set forth in claim 4 in which the part which can slide along the length of the bar contains the tensioning mechanism for setting force which the small diameter wheel exerts on the large diameter wheel and the tensioning mechanism comprises a spring-biased arm which is mounted for swinging motion on the part.

6. The boat lift as set forth in claim 4 in which the tensioning mechanism comprises an elastic cord having one end attached to the part and an opposite end attached to another part which can be slid along the bar and fastened to the bar to tension the cord.

7. The boat lift as set forth in claim 6 in which the pistol-grip handle has a base and the boat lift further comprises a support structure mounted on the frame for supporting the electric motor drive and comprising a platform on which the base of the pistol-grip handle rests, the platform being fastened to a torque bar which is parallel with the axis about which the small diameter wheel rotates.

8. The boat lift as set forth in claim 7 including a constraint which holds the pistol-grip handle fast to the torque bar.

9. The boat lift as set forth in claim 8 in which the constraint comprises a wrap which wraps around the pistol-grip handle and the torque bar.

10. The boat lift as set forth in claim 1 further comprising a reversible ratchet clutch through which the electric motor drive is coupled with the small diameter wheel.

11. The boat lift as set forth in claim 1 further comprising a fastening mechanism for fastening the part to the bar at a location to which the part has been slid.

* * * * *